US006736970B1

(12) United States Patent
Kivistöet al.

(10) Patent No.: US 6,736,970 B1
(45) Date of Patent: May 18, 2004

(54) ARRANGEMENT FOR TREATING SOLIDS SETTLED ON THE BOTTOM OF AN ELECTROLYTIC TANK

(75) Inventors: Tuomo Kivistö, Kirkkonummi (FI); Lauri Palmu, Helsinki (FI); Raimo Syväluoma, Merikarvia (FI); Jari Stenroos, Noormarkku (FI)

(73) Assignee: Outokumpu Oyj, Espoo (FI)

( * ) Notice: Subject to any disclaimer, the term of this patent is extended or adjusted under 35 U.S.C. 154(b) by 82 days.

(21) Appl. No.: 09/980,440

(22) PCT Filed: May 30, 2000

(86) PCT No.: PCT/FI00/00482

§ 371 (c)(1),
(2), (4) Date: Feb. 15, 2002

(87) PCT Pub. No.: WO00/79026

PCT Pub. Date: Dec. 28, 2000

(30) Foreign Application Priority Data

Jun. 17, 1999 (FI) ..... 991394

(51) Int. Cl.[7] ..... B01D 21/18; C02F 1/461

(52) U.S. Cl. ..... 210/243; 210/524; 210/527; 210/748; 204/275.1; 204/276; 205/705

(58) Field of Search ..... 210/523, 524, 210/526, 527, 748, 243; 204/275.1, 276, 269; 205/705

(56) References Cited

U.S. PATENT DOCUMENTS

| | | | | | |
|---|---|---|---|---|---|
| 616,891 | A | * | 1/1899 | Purton | 204/276 |
| 1,134,107 | A | * | 4/1915 | Craney | 204/276 |
| 2,009,559 | A | * | 7/1935 | Miedes | 210/527 |
| 2,888,143 | A | * | 5/1959 | Seidenstriches | 210/526 |
| 3,807,560 | A | * | 4/1974 | Pentz et al. | 210/527 |
| 3,890,214 | A | | 6/1975 | Kleveland | |
| 4,172,780 | A | * | 10/1979 | Kammel et al. | 204/276 |
| 4,302,331 | A | * | 11/1981 | Condit, Jr. | 210/526 |
| 4,303,491 | A | * | 12/1981 | Ferrari et al. | 204/279 |
| 5,047,150 | A | * | 9/1991 | Mitchell | 210/527 |
| 5,336,417 | A | * | 8/1994 | Hannum | 210/523 |
| 6,299,756 | B1 | * | 10/2001 | Marttila | 204/269 |

FOREIGN PATENT DOCUMENTS

| | | | |
|---|---|---|---|
| JP | 57098691 | | 6/1982 |
| WO | WO 99/11841 | * | 3/1999 |

* cited by examiner

*Primary Examiner*—Christopher Upton
(74) *Attorney, Agent, or Firm*—Smith-Hill and Bedell

(57) ABSTRACT

An arrangement for treating solids settled on the bottom of an electrolytic tank. Said arrangement comprises a collector element movable essentially along the bottom of the electrolytic tank or in the vicinity thereof, said collector element being provided with means for separating coarse particles from the rest of the solids.

19 Claims, 4 Drawing Sheets

ARRANGEMENT FOR TREATING SOLIDS SETTLED ON THE BOTTOM OF AN ELECTROLYTIC TANK

Figure 1:
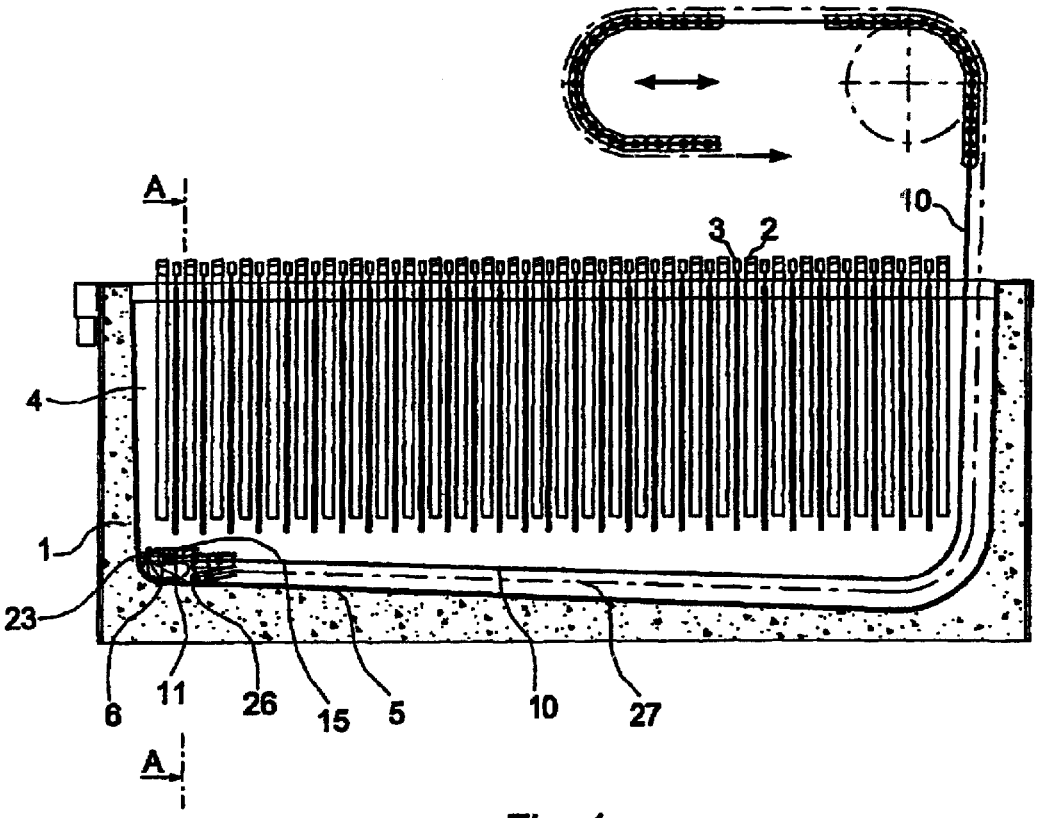

The present invention relates to an arrangement for treating solids settled on the bottom of an electrolytic tank.

In electrolytic processes, metals such as copper, nickel and zinc, are precipitated on the surfaces of cathodes located in the electrolytic tank, starting either with metal anodes that are dissolved into the electrolyte present in the electrolytic tank, or with metal ions that are already dissolved into the electrolyte. However, all solids are not precipitated onto the cathode surfaces, for example precious metals and solid impurities present in the electrolyte. Therefore on the bottom of electrolytic tanks, there are accumulated, along with the metal refining process, various solids that must from time to time be removed from the tank, for instance because said solids contain valuable ingredients, such as precious metals, or because a thicker solids accretion threatens the purity of the cathode obtained from the electrolytic process.

Usually the solids accumulated in the electrolytic tank are at least partly very finely divided and only somewhat heavier than the electrolyte, wherefore it is difficult to separate the solids from the electrolyte. During the electrolytic process, the circulation of the solids from off the bottom of the electrolytic tank is very harmful, because in that case there is a particularly high risk that the solids proceed onto the cathode, and this would essentially weaken the purity of the metal to be produced.

The removal of the solids accumulated on the bottom of an electrolytic tank usually requires that the whole electrolytic process must be interrupted, which reduces the efficiency per time, i.e. the productivity of the electrolytic plant. Hence the removal of solids must be arranged so that it forms part of the process of replacing the electrodes, i.e. anodes and cathodes; this, however makes the replacement process complicated and slow, and also restricts the removal of solids to take place in the rhythm dictated by the process of replacement. Moreover, a remarkable amount of the electrolyte must be first removed from the tank and then fed back therein, which generally leads to harmful effects in the electrolyte quality and causes a lot of extra work. Into the solids treatment system, there also flows a remarkable amount of electrolyte, which must be replaced with new and may be harmful in the further treatment of the solids. Moreover, the manual washing of the electrolytic tanks makes the process clearly more labor-intensive and subjects the employees to various health hazards, among others owing to the effects of the ingredients contained in the splashes and spray emanating from the tank. In addition, owing to the personnel required by the washing of the tanks, the automatization of the electrode treatment is often nearly impossible, which further increases the labor demand in an electrolytic plant.

From U.S. Pat. No. 6,299,756, there is known a separating element for separating the bottom part of an electrolytic tank from the rest of the tank space in connection with the removal of the solids settled on the tank bottom. In said publication, in the electrolytic tank there are arranged support and control members that form the trajectory of the separating element, so that the separating element can be placed in the electrolytic tank and removed therefrom through a space provided in between at least one end wall and the electrode placed nearest to said end wall. In the arrangement according to said publication, the separating element is provided with nozzles attached thereto, and through said nozzles, liquid or gas is conducted to the bottom part of the electrolytic tank in order to help remove the solids. The solids and liquid are removed for instance through a discharge aperture provided in the electrolytic tank bottom. However, the solids may contain particles that are coarser than the rest of the material and are not discharged in the manner described above. Owing to their larger size, they also may cause blockages in the outlet channels. Typically the particles with a larger grain size are separated from the finer slurry after the tank cleaning step.

The object of the invention is to realize a completely new type of arrangement to be used for treating the solids settled on the bottom of an electrolytic tank. The invention is characterized by the novel features set forth in the appended claims.

The arrangement according to the invention is characterized in that it comprises a collector element which is moved essentially along the electrolytic tank bottom or in the vicinity thereof, said collector element comprising means for separating coarse particles from the rest of the solids. By means of the arrangement according to the invention, coarse particles can be separated from the rest of the solids already in the electrolytic tank, preferably without having to first drain the electrolyte from the tank. The arrangement can also be used in connection with the cleaning of an already emptied tank.

A preferred embodiment of the arrangement according to the invention is characterized in that the means for separating coarse particles consist of a sieve element. By installing the sieve element in the collector element, there is obtained an advantageous and effective structure for separating and collecting coarse particles.

Another preferred embodiment of the invention is characterized in that in connection with the collector element, there is arranged a lid element, so that the collector element and/or the lid element are movable at least with respect to each other. By providing the collector element with a movable lid arrangement, it can be ensured that the separated coarse particles cannot move from the collector element back to the tank, when the collector element is being removed from the tank.

Another preferred embodiment of the invention is characterized in that the arrangement comprises means for directing a jet of some fluid or intermediate agent to the solids in the collecting direction prior to the collector element. By means of intermediate agent jets, the detaching of the solids from off the tank bottom can be boosted, and their transfer to the collector element as well as the separation of solids by the sieve element and the passage of the finer particles through the sieve can be intensified.

By providing the arrangement according to the invention preferably with at least one suction element arranged in succession to the collector element in the collecting direction, at least an essential part of the finer solids particles that penetrated the sieve element of the collector element are effectively removed from the tank.

Figure 2:
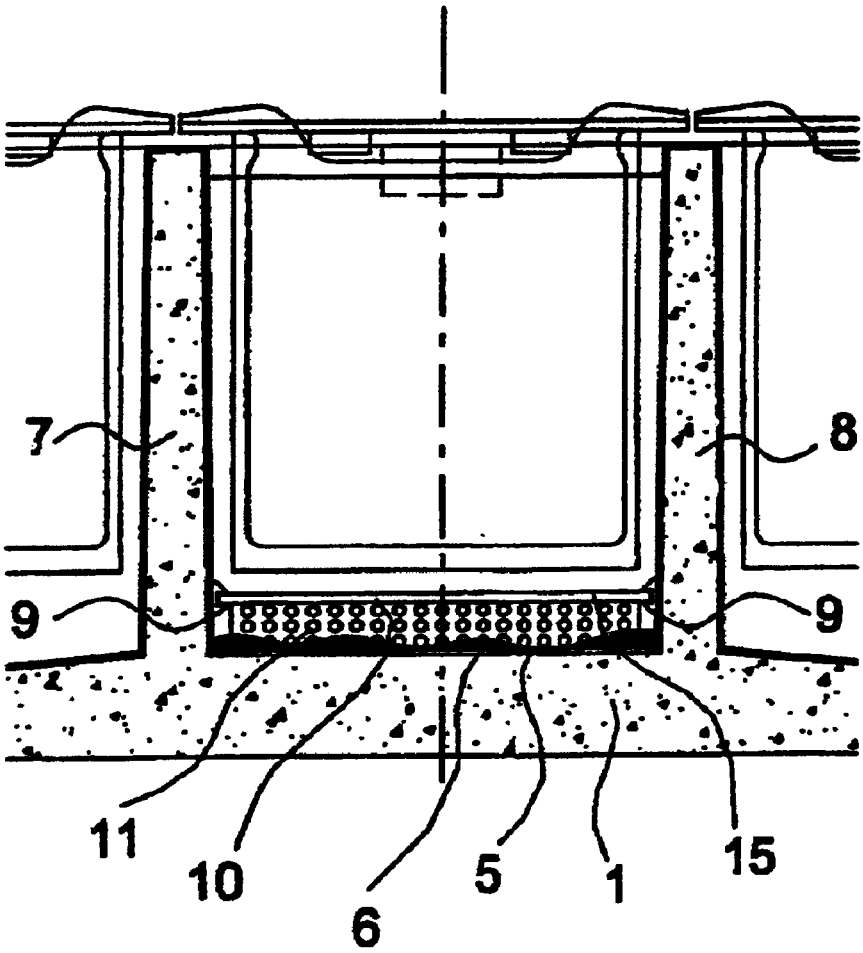
Figure 3:
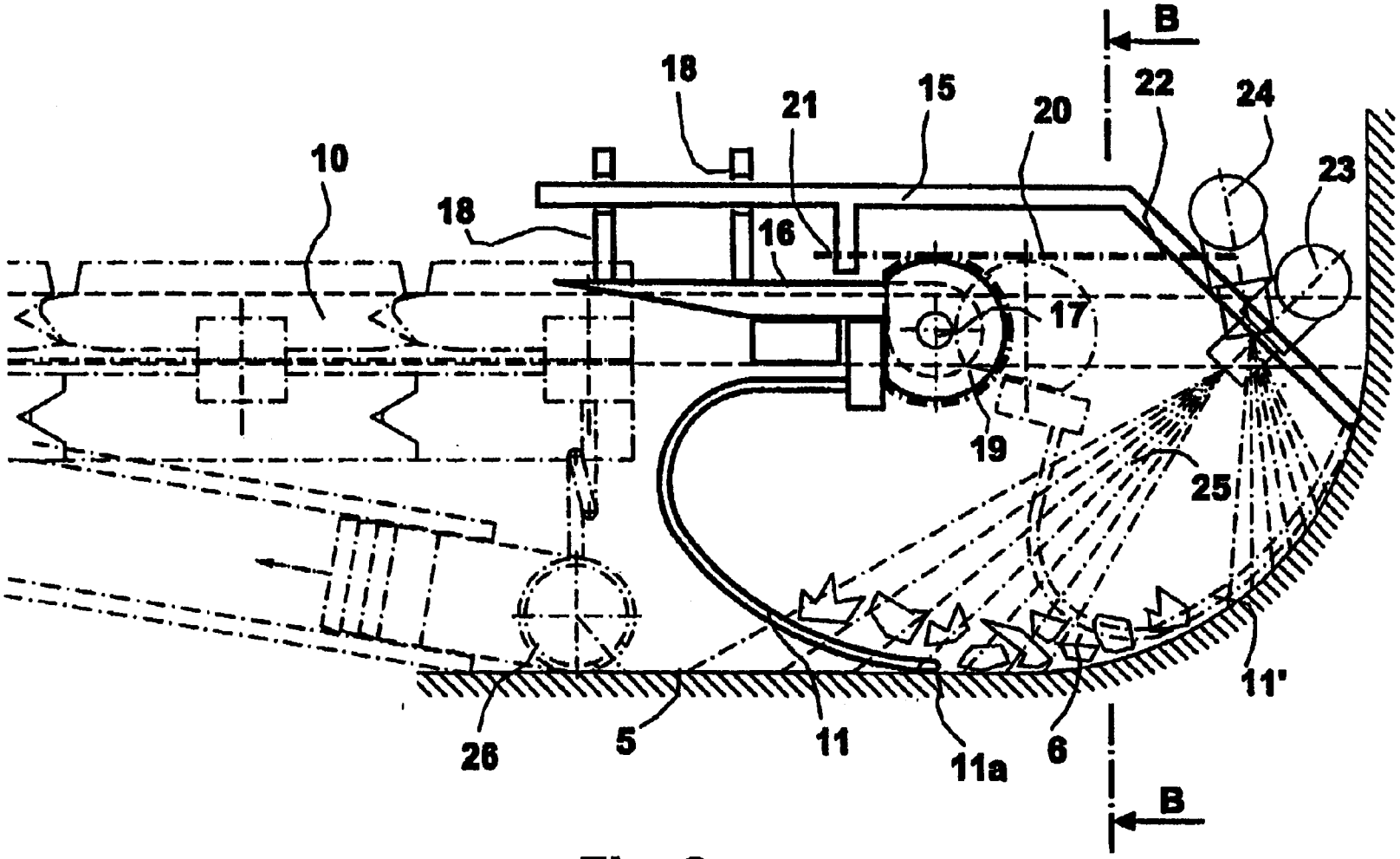
Figure 4:
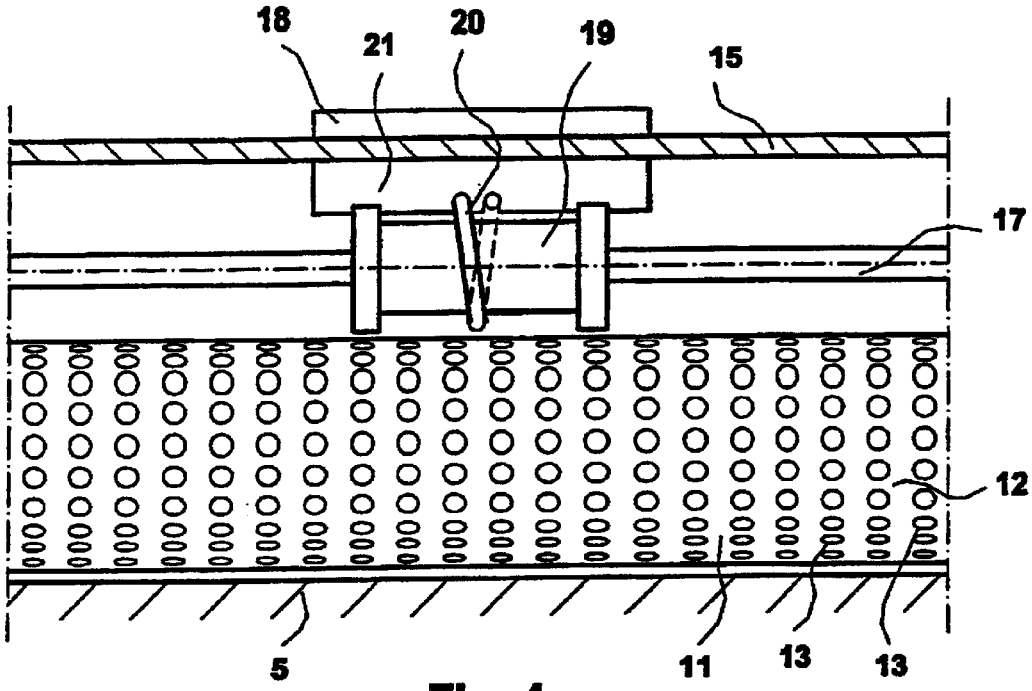
Figure 5:
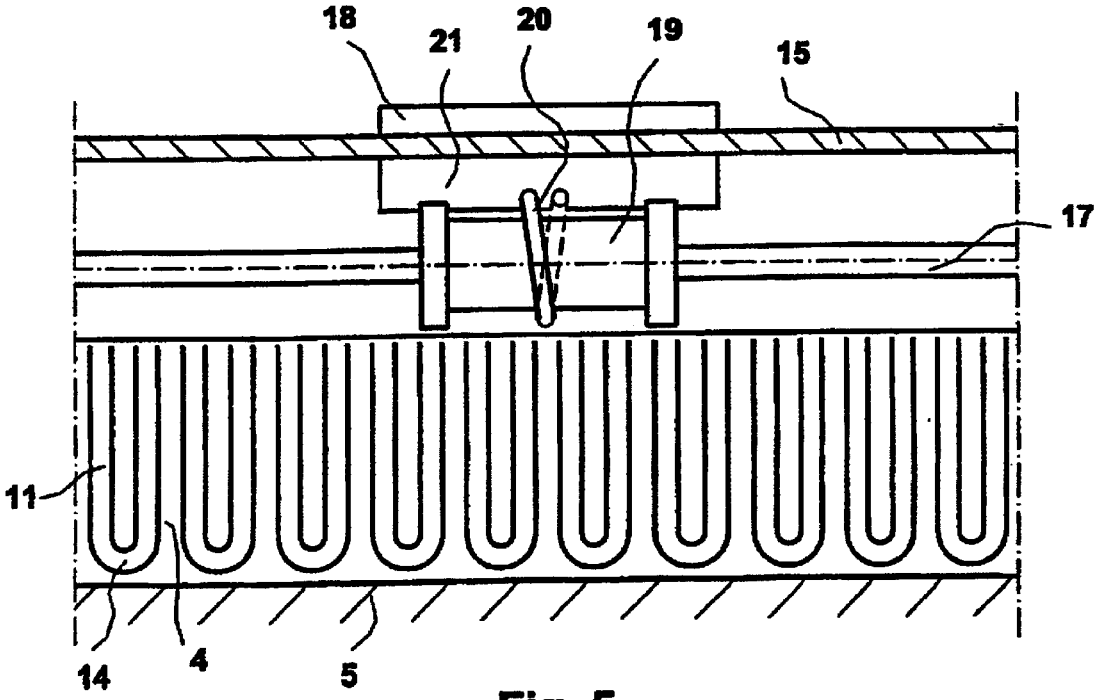

The invention is explained in more detail with reference to the appended drawings, where FIG. 1 shows a preferred embodiment of the invention in an electrolytic tank, seen in a side-view illustration in partial cross-section, FIG. 2 illustrates the embodiment of FIG. 1, seen in the direction A—A, FIG. 3 illustrates an embodiment of the arrangement according to the invention, seen in a partial side-view cross-section, FIG. 4 illustrates an embodiment according to the invention, seen in the direction B—B of FIG. 3, and FIG. 5 illustrates another embodiment according to the invention, seen in the direction B—B of FIG. 3.

FIGS. 1 and 2 represent a general illustration of an electrolytic tank 1, where there are in turns placed electrodes, anodes 2 and cathodes 3, and the metal to be produced in the electrolytic process is precipitated onto the cathode by means of an electrolytic solution 4 present in the electrolytic tank. During the electrolytic process, on the bottom 5 of the electrolytic tank 1 there are settled solids 6 that should be removed from the electrolytic tank from time to time.

The arrangement for treating the solids settled on the electrolytic tank bottom comprises a collector element 11, which is movable essentially along the bottom 5 of the electrolytic tank 1 or in the vicinity thereof, said collector element 11 comprising filter means for separating coarse particles from the rest of the solids. Said collector element 11 is typically formed to be for instance ladle-like in shape, so that in the collecting position, the front edge 11*a* of the collector element is arranged against the tank bottom 5, in which case, when moving the collector element, the solids 6 settled on the tank bottom are transferred to the collector element, onto the means provided therein for separating coarse particles from the rest of the solids. In a typical example, the size of the coarse particles is of the order 2–60 mm.

The means provided in the collector element for separating coarse particles typically consist of a sieve element 12. As for the sieve element it is typically formed on the inner surface of the collector element, in which case the coarser particles are left in the collector element, whereas the finer particles pass through the sieve elements arranged in the collector element. According to a preferred embodiment (FIG. 4), the collector element is at least partly made of a plate provided with apertures 13, and the size of said apertures 13 is matched according to the desired separating capacity. The size and shape of the apertures 13 provided in the sieve element depend on the properties of the solids under treatment.

According to another preferred embodiment (FIG. 5), the sieve element of the collector element 11 is composed of bar elements 14 that are spaced apart The mutual distance between the adjacent bar elements is matched according to the desired separating capacity. Thus at least one wall of the collector element 11 is made rake-like, so that the bar elements 14 represent the peaks in said rake element. In the case according to the drawing, the bar elements 14 are bent double, at least at the end that is in contact with the tank bottom 5, preferably essentially in an U-shape.

In a preferred embodiment according to the invention, in connection with the collector element 11, there is arranged a lid element 15, so that the collector element 11 and/or the lid element 15 are movable at least with respect to each other. According to a preferred embodiment, the collector element 11 is arranged turnably in a separating wall or member 10 that is coupled to a mechanism (not shown) for advancing and retracting the separating wall. Thus the separating wall serves as a drive apparatus for the collector element. The collector element is arranged to turn from the collecting position to the top position 11' (illustrated by dotted lines in FIG. 3), in which top position the lid element 15 prevents the coarse particles that are left in the collector element 11 from flowing out of the collector element for instance when the collector element is being removed from the tank 1. In the embodiment of FIG. 3, the lid element 15 is arranged in the separating wall 10, movably at the edge thereof. Between the lid element 15 and the collector element 11, there is arranged transmission, for example wire transmission. The lid element 15 is installed in the separating wall 10, at the front edge and movably in the motional direction thereof, so that when the lid element 15 touches the (end) wall of the tank, the lid element 15 is stopped, while the fastening point of the collector element 21 still proceeds somewhat towards the wall. Now the wire transmission turns the collector element from the collecting position to the top position 11', where the collector element is advantageously locked. Thereafter the collector element 11 can be removed from the tank 1, for example by moving it by the drive apparatus 10 to the direction opposite to the collecting direction.

The collector element 11 is attached, by intermediation of a fastening element 16, to the drive apparatus 10. In the fastening element, there is provided a transversal axis element 17, around which the collector element is turnably arranged. The lid element 15 is installed, by intermediation of at least one support member 18, so that it is movable back and forth in the collecting direction. In the embodiment according to FIG. 3, the motion of the lid element 15 is transformed by transmission means 19, 20, particularly wire transmission means, to a rotary motion of the collector element 11 around the axis 17. Around the axis 17, there is provided a sleeve element 19 to which the collector element 11 is attached. Around the sleeve element 19, there is wound a cable wire 20, which is fastened, at least in one point, to the sleeve element 19. The first end of the wire 20 is attached to the lid element, to a first fastening point 21, and the other end of the wire is attached to the lid element, to a second fastening point 22. The first fastening point 21 and the second fastening point 22 of the wire are located, in the motional direction of the lid element 15, on opposite sides of the turning axis 17 of the collector element. This is only one alternative for turning the collector element 11 against the lid element 15. For a man skilled in the art, it is obvious that other turning arrangements can be used in connection with the collector element.

The collecting and separating effects of the arrangement according to the invention can be intensified, when the arrangement comprises means 23, 24 for directing a jet 25 of some intermediate agent to the solids 6 in the collecting direction, prior to the collector element 11. The intermediate agent jets push the solids 6, particularly the finer solids, towards the collector element 11, and further through the sieve element 12, 14.

The arrangement may comprise suction elements 26 that are advantageously positioned in the collecting direction after the collector element, in order to remove from the tank at least part of the finer solid particles that have passed the sieve of the collector element 11. Thus the bottom 5 of the electrolytic tank is cleared of solids 6, and simultaneously the solids are classified according to particle size. The separating capacity can be boosted further, when the means for directing an intermediate agent jet to the solids comprise at least one nozzle 23, which is directed towards the sieve element 12, 14 of the collector element. The nozzles 23, 24 can be arranged for example in the lid element 15, which in the collecting position extends to a distance from the collector element 11 in the collecting direction.

In the embodiment according to FIGS. 1 and 2, the arrangement according to the invention is attached to the separating wall 10, which at the same time serves as the drive apparatus of the collector element. In connection with the electrolytic tank, preferably in the side walls 7, 8 of the tank, there are provided support and control members 9. By means of the support and control members 9, the separating element serving as the drive apparatus is supported, while the separating element is placed in the electrolytic tank 1, and controlled while it is being immersed in the electrolytic tank, in which case the created trajectory is mainly defined by the support and control members. Typically the employed support and control members 9 are grooves provided in the opposite walls 7, 8 of the tank, wherein the side edges of the separating element 10 are matched to fit. One embodiment of said separating wall in described in U.S. Pat. No. 6,299,756.

The arrangement according to the invention is operated for instance as follows. The arrangement is transferred onto the bottom of an electrolytic tank, for example at one end of the tank, between the tank wall and the electrode that is located nearest to said wall. The collector element is moved along the bottom, so that the solids settled on the bottom are treated with the collector element. The finer solid particles pass the sieve provided in the collector element, whereas the coarser particles remain in the collector element. The finer particles that passed the sieve of the collector element 11 are conducted, along a conduit 27, out of the tank; they are collected in said conduit 27 by means of at least one suction element 26 that is located in succession to the collector element 11 in the collecting direction. The collecting and/or separating effect can be further intensified by directing jets 25 of some intermediate agent to the material 6 under treatment, in the collecting direction prior to the collector element and/or to the sieve of the collector element 11. When the collector element 11 has reached the opposite end of the tank, the collector element rises to the top position 11', where the front edge 11*a* of the collector element is placed essentially against the lid element 15. The coarser particles collected in the collector element 11 remain in the collector element 11 while it is moved to the opposite direction, out of the tank. Typically the collector element is first stopped at a short distance from the final position, and underneath it there is placed a vessel for receiving the coarser particles. Then the collector element is transferred to the unloading position, where it is opened and the coarser particles are shifted from the collector element to the reception vessel. During said treatment, the electrolyte can typically be immersed in the tank.

For a man skilled in the art, it is obvious that the invention is not restricted to the above described embodiments only, but it can be modified within the scope of the appended claims.

What is claimed is:

1. An electrolytic apparatus comprising:

an electrolytic tank defining an interior space and having a floor, a separating member for separating a lower part of the interior space from an upper part thereof, the separating member being movable within the tank, and a collector element attached to the separating member whereby the separating member acts as a drive apparatus for the collector element, causing the collector element to move across the floor of the electrolytic tank forward in a collecting direction and backwards in a removal direction, the collector element including a filter means that extends into the lower part of the interior space.

2. An arrangement according to claim 1, further comprising a lid element that is connected to the collector element in a manner such that the lid element is movable with respect to the collector element.

3. An arrangement according to claim 2, wherein the filter means is installed in the collector element in such a way that the filter means is turnable with respect to the lid element.

4. An arrangement according to claim 3, wherein the filter means is installed in the collector element in such a way that the filter means locks against the lid element in a top position so that material collected by the collector element is trapped between the filter means and the lid element.

5. An arrangement according to claim 2, wherein the lid element is connected to the collector element in such a way that when the lid element is prevented from moving in the collecting direction by engagement with a wall of the electrolytic tank, the collector element will continue to move in the collecting direction.

6. An arrangement according to claim 1, wherein the filter means comprises a plate provided with apertures.

7. An arrangement according to claim 1, wherein the filter means comprises a sieve element.

8. An arrangement according to claim 1, wherein the filter means comprises a rake element.

9. An arrangement according to claim 1, further comprising a directing means that is forward of the collector element for directing at least one fluid jet towards the filter means and displacing solids settled on the floor of the tank towards the filter means.

10. An arrangement according to claim 9, wherein the directing means comprises at leant one nozzle that is directed towards the filter means.

11. An arrangement according to claim 1, further comprising at least one suction element to the rear of the collector element for removing solids that pass through the filter means.

12. An electrolytic apparatus comprising:

an electrolytic tank having a floor, a front wall and a rear wall, electrodes suspended within the tank, there being a lower region of the tank beneath the electrodes, a separating member movable within the tank, support and control members within the tank for guiding the separating member along a path traversing the lower region of the tank, wherein when the separating member is in the lower region of the tank it separates the electrodes from a bottom part of the lower region of the tank and remain substantially above the floor of the tank, and a collector element attached to the separating member whereby the separating member acts as a drive apparatus for the collector element, causing the collector element to move across the floor of the electrolytic tank forward in a collecting direction from the rear wall of the tank to the front wall of the tank and backwards in a removal direction, the collector element including a filter means that extends substantially to the floor of the tank.

13. An arrangement according to claim 12, further comprising a lid element that is connected to the collector element in a manner such that the lid element is movable with respect to the collector element.

14. An arrangement according to claim 13, wherein the filter means is installed in the collector element in such a way that the filter means is turnable with respect to the lid element.

15. An arrangement according to claim 14, wherein the filter means is installed in the collector element in such a way that the filter means locks against the lid element in a top position so that material collected by the collector element is trapped between the filter means and the lid element.

16. An arrangement according to claim 13, wherein the lid element is connected to the collector element in such a way that when the lid element is prevented from moving in the collecting direction by engagement with the front wall of the electrolytic tank, the collector element will continue to move in the collecting direction.

17. An arrangement according to claim 12, wherein the filter means is installed in the collector element in such a way that the filter means can move turnably with respect to the separating member.

18. An arrangement according to claim 12, further comprising a directing means that is forward of the collector element for directing at least one fluid jet towards the filter means and displacing solids settled on the bottom of the tank towards the filter means.

19. An arrangement according to claim 12, further comprising at least one suction element to the rear of the collector element for removing solids that pass through the filter means.

* * * * *